US011085594B2

(12) United States Patent
Bufalini, Jr. et al.

(10) Patent No.: US 11,085,594 B2
(45) Date of Patent: Aug. 10, 2021

(54) MODULAR LIGHTING SYSTEM AND INTERCONNECTABLE LIGHTING CELLS

(71) Applicant: XAL Inc., New York, NY (US)

(72) Inventors: Mario Bufalini, Jr., Oxford, CT (US); Dylan Scaife, Prospect, CT (US)

( * ) Notice: Subject to any disclaimer, the term of this patent is extended or adjusted under 35 U.S.C. 154(b) by 0 days.

(21) Appl. No.: 16/712,987

(22) Filed: Dec. 12, 2019

(65) Prior Publication Data

US 2021/0180757 A1 Jun. 17, 2021

(51) Int. Cl.

| | |
|---|---|
| ***F21S 2/00*** | (2016.01) |
| ***F21V 21/005*** | (2006.01) |
| ***F21V 15/01*** | (2006.01) |
| ***F21V 5/02*** | (2006.01) |

(52) U.S. Cl.

CPC ..... *F21S 2/005* (2013.01); *F21V 5/02* (2013.01); *F21V 15/01* (2013.01); *F21V 21/005* (2013.01)

(58) Field of Classification Search

CPC ..... F21S 2/005; F21V 21/005

See application file for complete search history.

(56) References Cited

U.S. PATENT DOCUMENTS

| | | | | |
|---|---|---|---|---|
| 5,520,396 | A | 5/1996 | Therrien et al. | |
| 5,600,910 | A * | 2/1997 | Blackburn | F21S 2/005 273/157 R |
| 7,355,562 | B2 * | 4/2008 | Schubert | G09F 9/3026 345/1.3 |
| 7,963,669 | B2 | 6/2011 | Hockel et al. | |
| 8,066,403 | B2 | 11/2011 | Sanfilippo et al. | |
| 10,174,888 | B1 | 1/2019 | Narushima et al. | |
| 2005/0007780 | A1 | 1/2005 | Feuerborn | |
| 2006/0134978 | A1 | 6/2006 | Rosen et al. | |
| 2009/0237936 | A1 * | 9/2009 | Ku | F21V 21/005 362/249.14 |
| 2011/0317420 | A1 * | 12/2011 | Jeon | F21V 29/763 362/249.02 |
| 2012/0182739 | A1 * | 7/2012 | Leung | F21S 2/005 362/249.06 |
| 2019/0271461 | A1 | 9/2019 | Hierzer | |
| 2020/0332992 | A1 * | 10/2020 | Zhang | F21S 2/005 |

FOREIGN PATENT DOCUMENTS

| | | | |
|---|---|---|---|
| DE | 202007001243 | U1 | 5/2007 |
| DE | 102006018668 | A1 | 10/2007 |

OTHER PUBLICATIONS

International Search Report and Written Opinion from PCT/US2020/061929, dated Mar. 15, 2021.

* cited by examiner

*Primary Examiner* — William N Harris

(74) *Attorney, Agent, or Firm* — Davidson, Davidson & Kappel, LLC

(57) ABSTRACT

A modular lighting cell includes a light assembly, a housing including a plurality of side walls, and a cover. The housing and the cover enclose the light assembly. The modular lighting cell also includes a connector. The connector and at least one of the side walls are configured such that the connector is removably connectable to the at least one side wall. A modular lighting unit includes a first lighting cell including a first light assembly and a first housing receiving the first light assembly; a second lighting cell including a second light assembly and a second housing receiving the second light assembly; and a connector configured for connecting to the first lighting cell and for connecting to the second lighting cell to connect the first light cell and the second lighting cell to each other.

23 Claims, 16 Drawing Sheets

MODULAR LIGHTING SYSTEM AND INTERCONNECTABLE LIGHTING CELLS

The present disclosure relates generally to lighting and more specifically to interconnectable lighting cells forming a modular lighting system.

BACKGROUND

Conventionally, overhead LED lighting systems include a plurality of lights that are integrally interconnected together as a single piece.

SUMMARY OF THE INVENTION

A modular lighting cell includes a light assembly, a housing including a plurality of side walls, and a cover. The housing and the cover enclose the light assembly. The modular lighting cell also includes a connector. The connector and at least one of the side walls are configured such that the connector is removably connectable to the at least one side wall.

A modular lighting cell includes a light assembly, a housing includes a plurality of side walls, and a cover. The housing and the cover enclose the light assembly. The modular lighting cell further includes a connector. The connector and at least one of the side walls is configured such that the connector is connectable to each of the side walls one at a time.

A modular lighting unit includes a first lighting cell including a first light assembly and a first housing receiving the first light assembly; a second lighting cell including a second light assembly and a second housing receiving the second light assembly; and a connector configured for connecting to the first lighting cell and for connecting to the second lighting cell to connect the first light cell and the second lighting cell to each other.

BRIEF DESCRIPTION OF THE DRAWINGS

The present invention is described below by reference to the following drawings, in which.

DETAILED DESCRIPTION

Figure 1A:
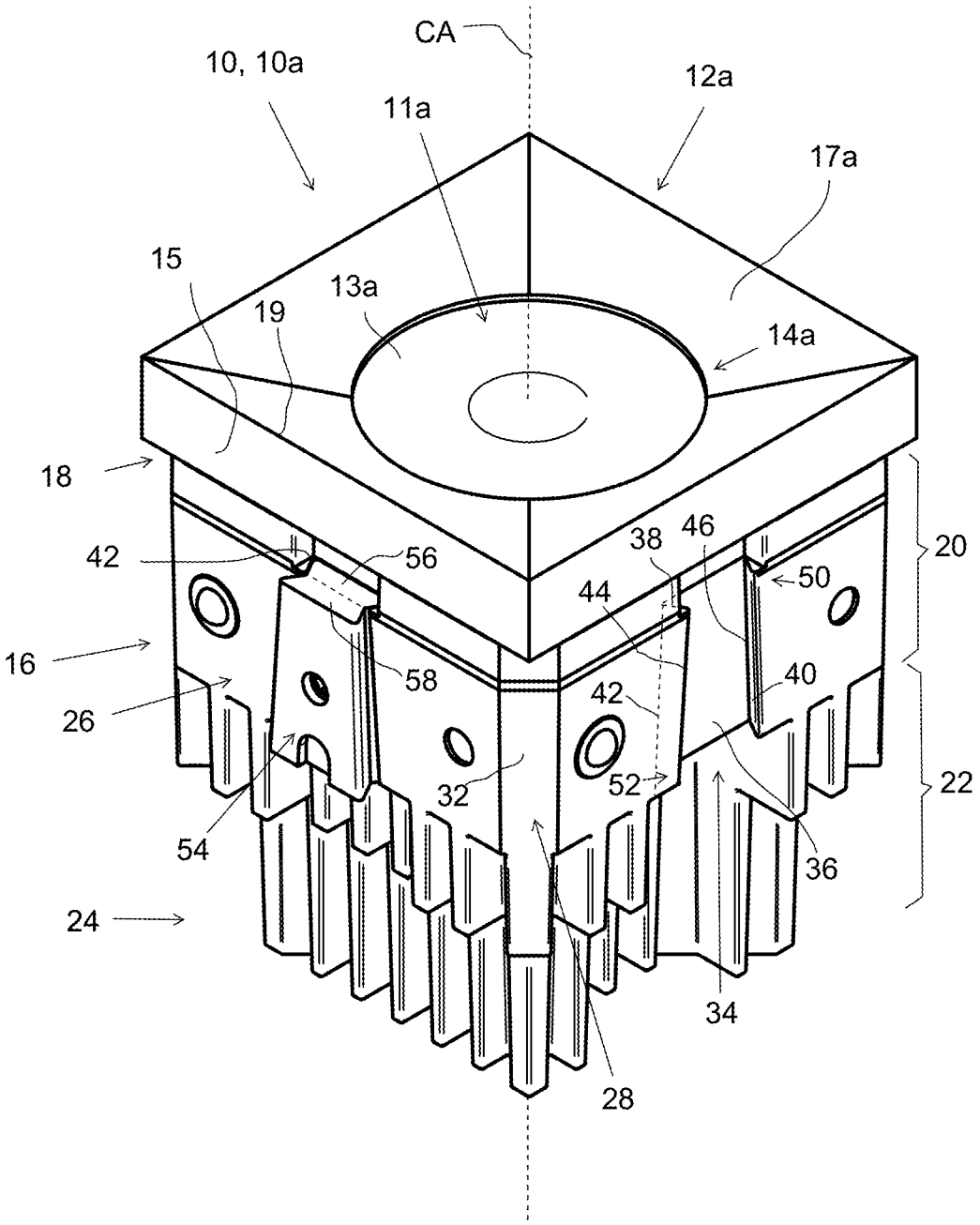
FIGS. 1*a* to 1*b* show perspective views of two different interconnectable lighting cells in accordance with an embodiment of the present invention.
Figure 1B:
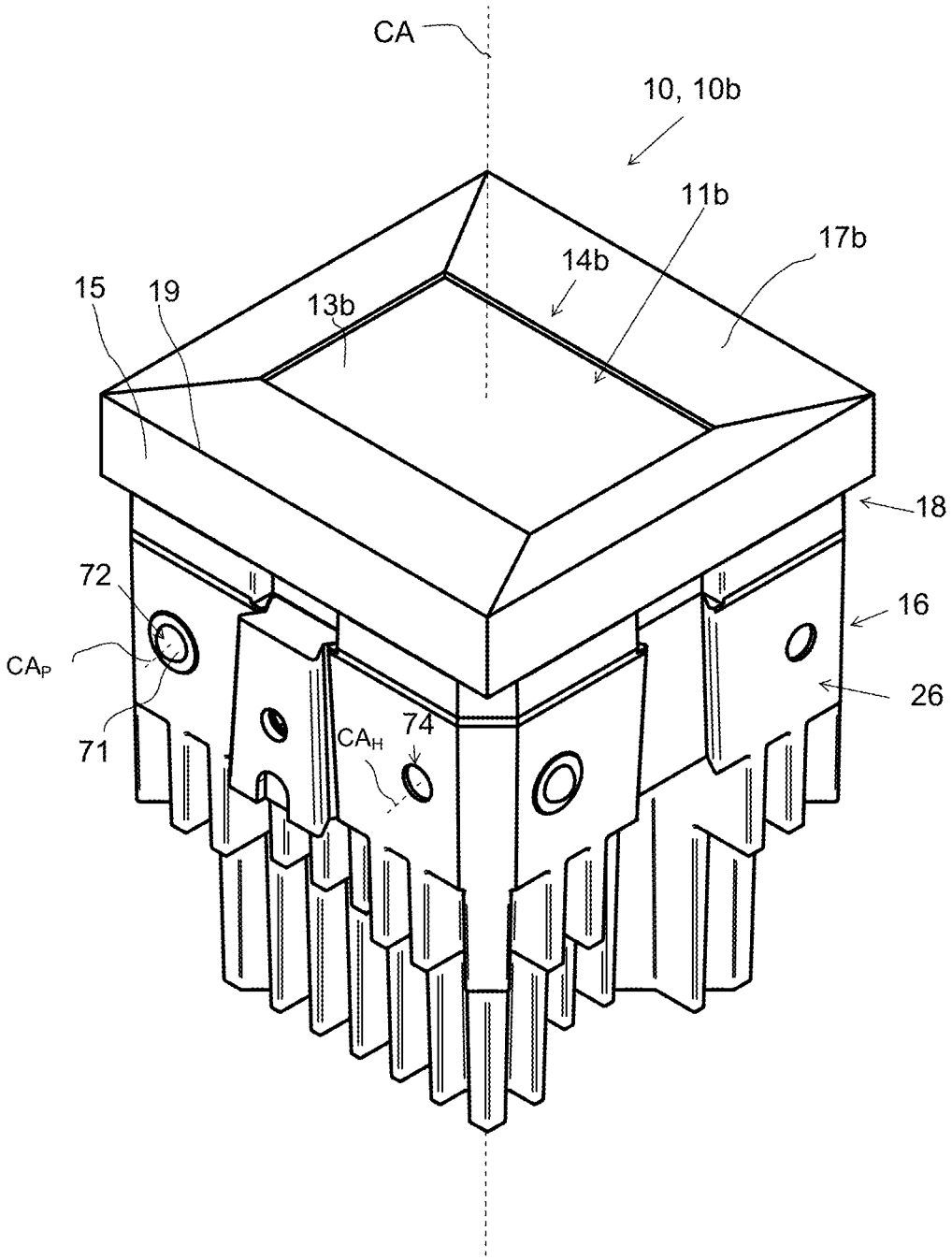
Figure 2:
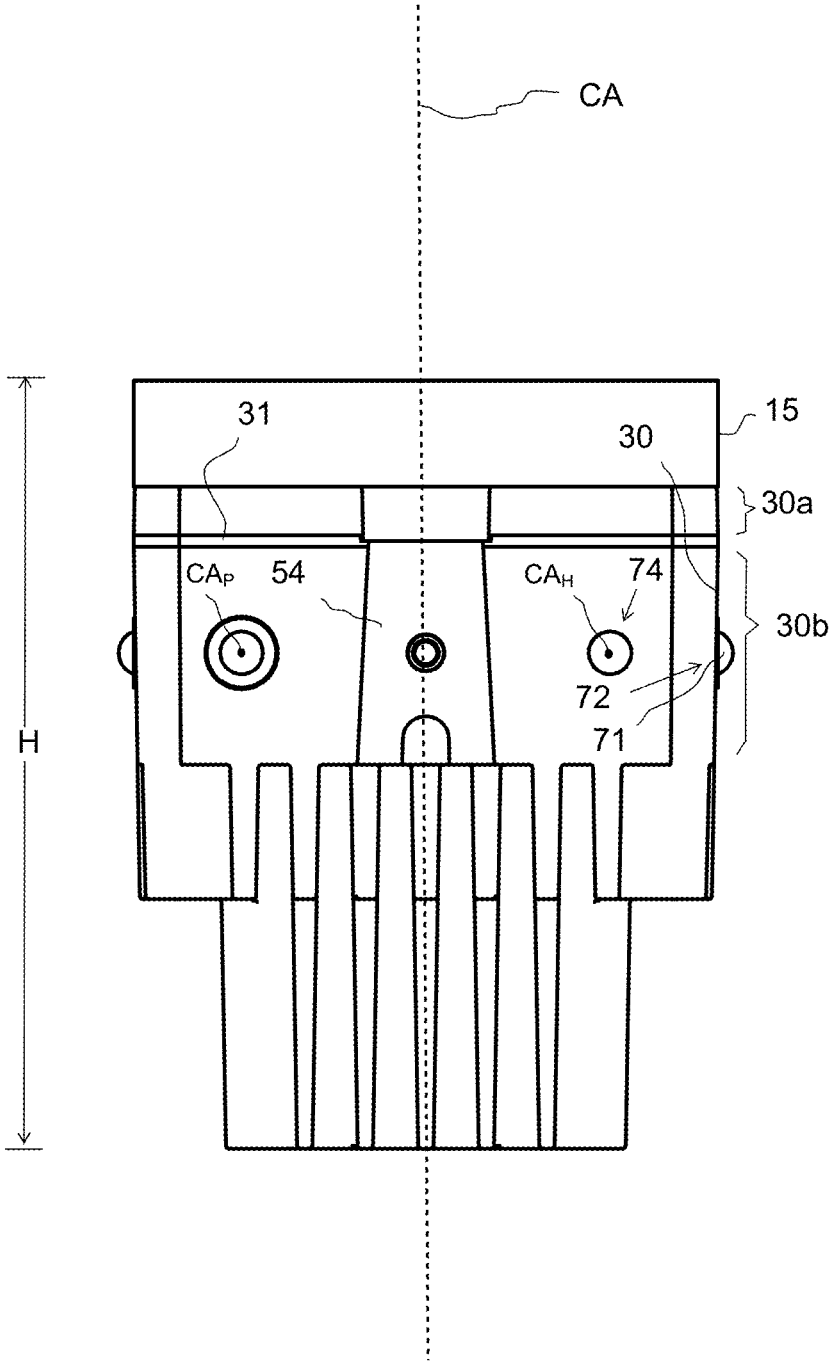
FIG. 2 shows a side elevational view of one of the lighting cells.
Figure 3:
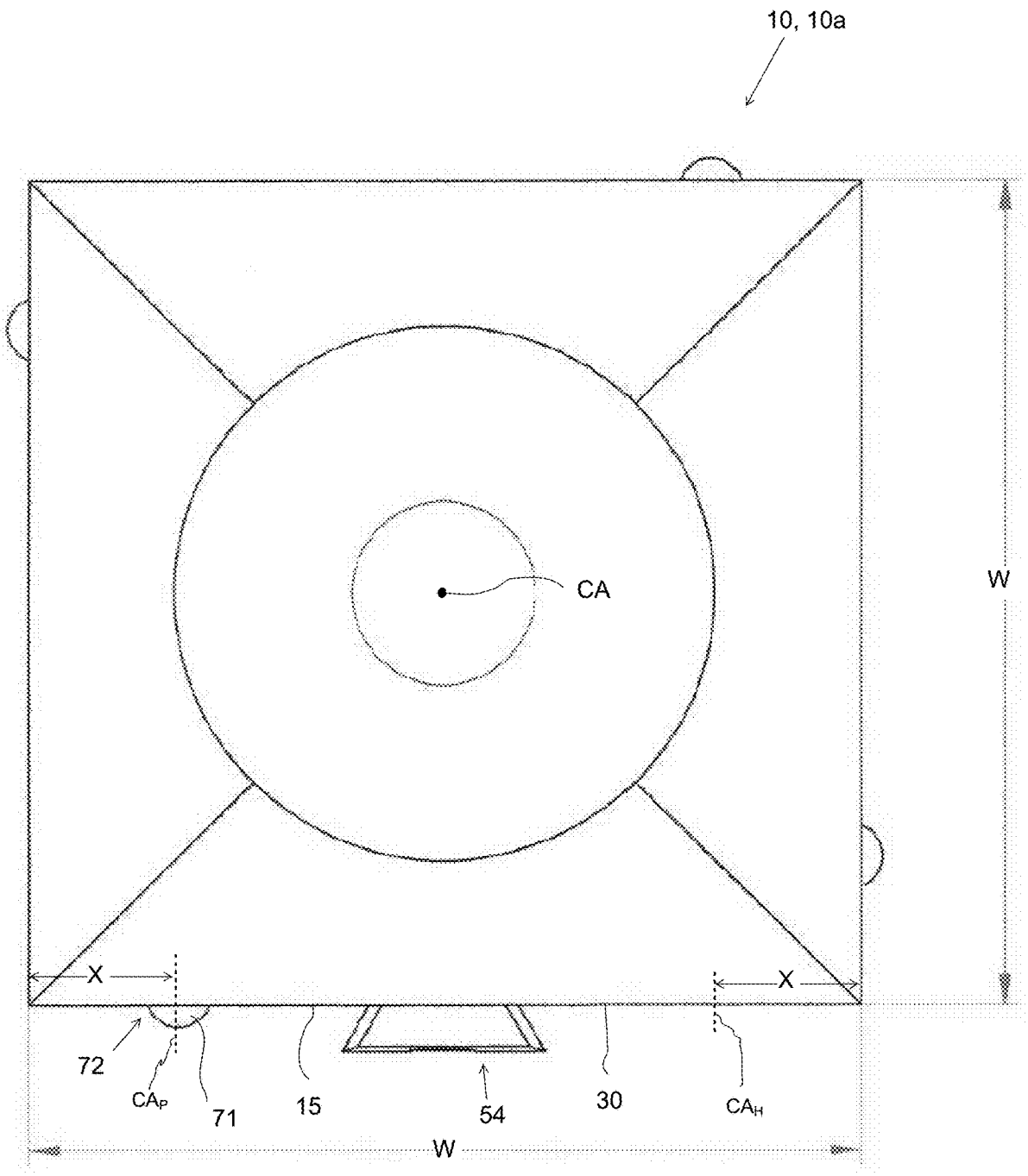
FIG. 3 shows a top plan view of lighting cell shown in FIG. 1*a;*

FIGS. 1*a* and 1*b* show perspective views of two different interconnectable lighting cells 10—denoted as lighting cells 10*a*, 10*b* in FIGS. 1*a* and 1*b*, respectively, in accordance with an embodiment of the present invention. FIG. 2 shows a side elevational view of a lighting cell 10, which could be either of cells 10*a* and 10*b*, and FIG. 3 shows a top plan view of lighting cell 10*a*. Lighting cells 10*a*, 10*b* are configured in the same manner as each other, except that each lighting cell 10*a*, 10*b* may include a different light assembly 11*a*, 11*b* and a different respective cover 12*a*, 12*b* so that the beam angle of each of cells 10*a*, 10*b* is different. Lighting cells 10*a*, 10*b* are each centered on a respective center axis CA. Unless otherwise specifically, the terms circumferential, axial and radial and derivatives thereof are used in reference to center axis CA. Cell 10*a* includes a cover 12*a* defining a circular hole 14*a* passing axially therethrough and cell 10*b* includes a cover 12*b* defining a rectangular hole 14*b* passing axially therethrough. Center axis CA of cell 10*a* passes directly through a center of circular hole 14*a* and center axis CA of cell 10*b* passes directly through a center of circular hole 14*b*.

As described in reference to the views shown in FIGS. 1*a* and 1*b*, covers 12*a*, 12*b* are each configured to sit on top of a respective light assembly 11*a*, 11*b*. As discussed further below with respect to FIGS. 1*d* and 1*e*, the light assemblies 11*a*, 11*b* are each formed by a respective light source 25*a*, 25*b*, in the form of a LED, for emitting light and optics 13*a*, 13*b*, e.g., a lens, for directing a light beam through the respective cover 12*a*, 12*b*. The light assemblies 11*a*, 11*b* are within the respective covers 12*a*, 12*b* and covers 12*a*, 12*b* each rest on the respective light assembly 11*a*, 11*b*. Each of optics 13*a*, 13*b* is visible through the hole 14*a*, 14*b* in the respective cover 12*a*, 12*b*.

In the embodiment shown in FIGS. 1*a* and 1*b*, covers 12*a*, 12*b* have a square shaped outer cross-section and each include four side surfaces 15 of the same width. Respective top surfaces 17*a*, 17*b* of covers 12*a*, 12*b* are recessed below top edges 19 of side surfaces 15 and extend radially inward from the respective top edges 19 to the respective hole 14*a*, 14*b* in a downwardly tapered manner.

Each lighting cell 10*a*, 10*b* includes an identical housing 16 supporting the respective cover 12*a*, 12*b*. Covers 12*a*, 12*b* are each removably fixed on a first axial end 18 of the housing 16, for example by a snap joint, with the cover 12*a*, 12*b* and housing 16 enclosing the optics 13*a*, 13*b*. Housing 16 includes a hollow base 20 that is fixed to the respective cover 12*a*, 12*b* and heat sink 22 that is axially separated from cover 12*a*, 12*b*, by base 20. Base 20 receives the optics 13*a*, 13*b* and includes an opening at end 18 of base 16 through which the optics 13*a*, 13*b* is inserted during the assembly of the cell 10*a*, 10*b*. Heat sink 22 defines a second axial end 24 of housing 16 that is opposite of axial end 18 to which cover 12*a*, 12*b* is fixed. Base 20 includes four walls 26 and corner section 28 extending axially from the respective cover 12*a*, 12*b* to the heat sink 22, with corner sections 28 each connecting the two adjacent walls. In the embodiment shown in FIGS. 1*a* and 1*b*, walls 26 are all identical and corner sections 28 are all identical. Walls 26 define a square cross-section and corner sections 28 are beveled with respect to walls 26. In other words, outer surfaces 30 of walls 26 define planes that intersect to define a square, and outer surfaces 32 of corner sections 28 are beveled with respect outer surfaces 30 such that each of surfaces 32 forms an obtuse angle with respect to each of the two adjacent surfaces 30. More specifically, outer surfaces 30 of walls 26 are planar and are each arranged perpendicular to the surface 30 of each of the two adjacent walls 28.

Figure 1C:
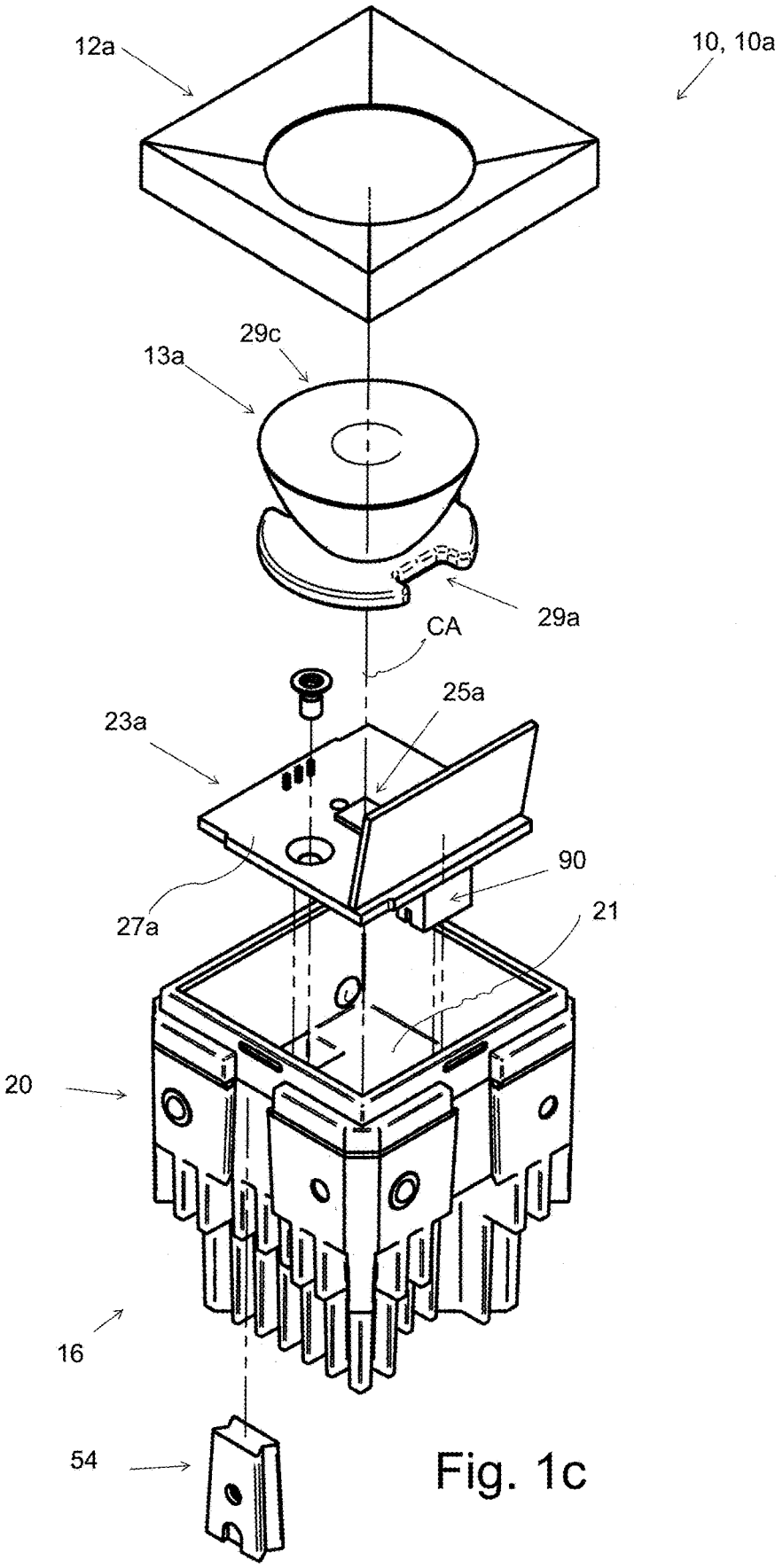
FIGS. 1*c* and 1*d* show exploded views of the lighting cells shown in FIGS. 1*a* and 1*b*, respectively.
Figure 1D:
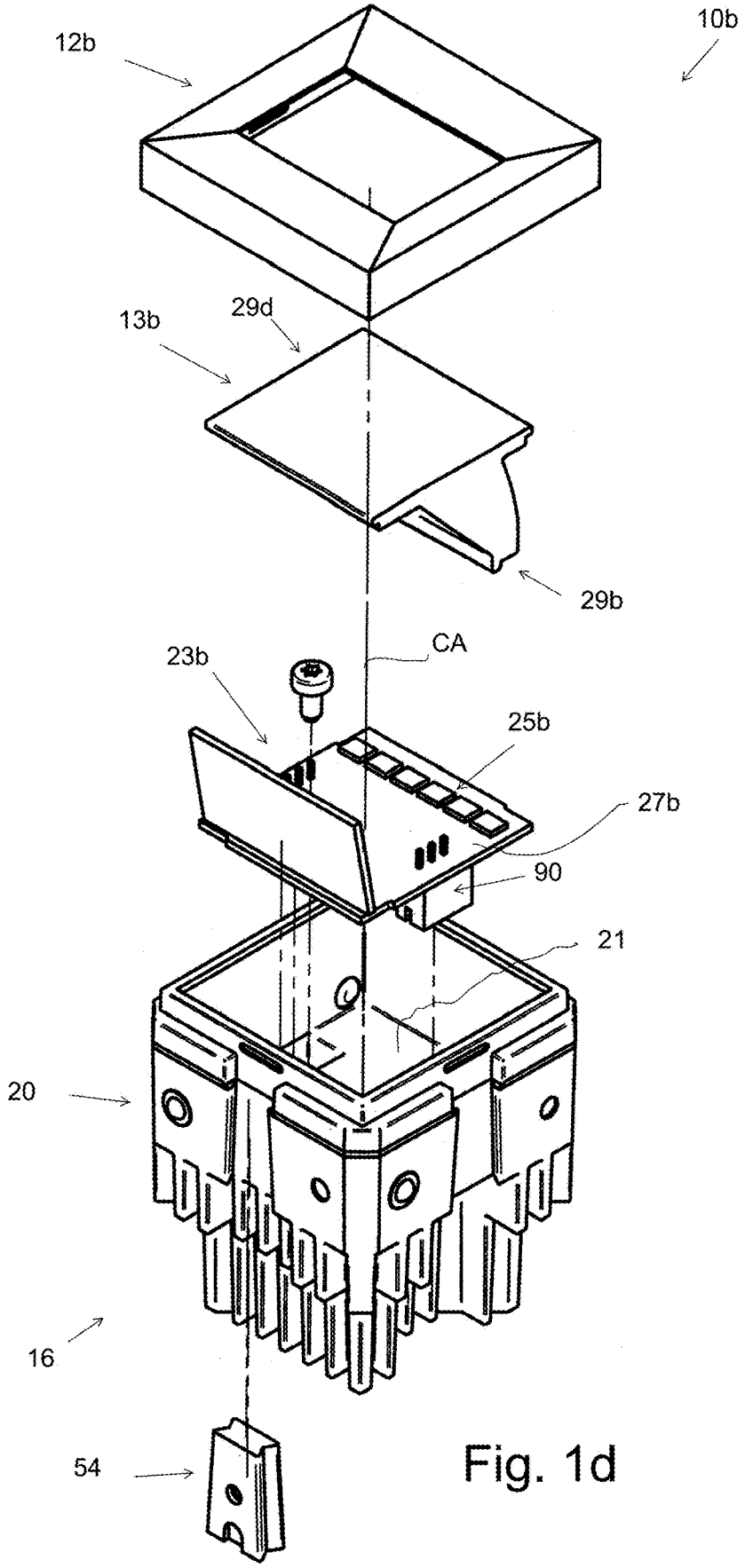

FIGS. 1*c* and 1*d* show exploded views of lighting cells 10*a*, 10*b*, showing hollow base 20 and a support surface 21 of base 20. Support surface 21 includes two through holes formed therein each for receiving a respective electrical receptacle 90, 91 (FIG. 7) which are fixed to the bottom of a control circuit 23*a* or 23*b*. Control circuits 23*a*, 23*b* each rest on the respective support surface 21 inside of the respective base 20. A respective light source 25*a*, 25*b* is provided on top of a respective circuit board 27*a*, 27*b* of control circuits 23*a*, 23*b*. A first end 29*a*, 29*b* of each of optics 13*a*, 13*b* is inserted onto light source 25*a*, 25*b* such that the light source 25*a*, 25*b* emits light into optics 13*a*, 13*b* and optics 13*a*, 13*b* directs the light out through a respective second end 29*c*, 29*d* through the respective cover 12*a*, 12*b* in a preconfigured manner in a predefined beam angle. Each of optics 13*a*, 13*b* is positioned in the hollow base 20 axially between the respective control circuit 23*a*, 23*b* and the respective cover 12*a*, 12*b*. As shown in FIGS. 1*c*, 1*d*, each light source 25*a*, 25*b* can be formed of one or more LEDs. In the shown embodiments, light source 25*a* is formed by a single diode and light source 25*b* is formed by six LEDs. First end 29*a* of optics 13*a* is adhered to a top surface of circuit board 27*a*, while first end 29*b* of optics 13*b* sits over LEDs of light source 26*b*, and second end 29*d* of optics 13*b* attached to cover 12*b*.

Walls 26 are each provided with an axially extending slot 34 that is recessed into the respective wall 26 away from surface 30. Slot 34 is defined by a base surface 36 that is parallel to the respective outer surface 30 and two edge surfaces 38, 40 that laterally delimit slot 34, with base surface 36 extending laterally from edge surface 38 to edge surface 40. Edge surface 38 joins base surface 36 at an edge 42 and joins outer surface 30 at an edge 44 and edge surface 40 joins base surface 36 at an edge 46 and joins outer surface 30 at an edge 48. Slot 34 has a trapezoidal cross-section define by surfaces 36, 38, 40 and a plane passing edge 44 to 48. Slot 34 is tapered longitudinally and tapered depthwise. Slot 34 is tapered depthwise because the trapezoidal cross-section of slot 34 wider as slot 34 extends into the respective wall 26. More specifically, edge surfaces 38, 40 are each arranged at an acute angle with respect to base surface 36 and at an acute angle with respect to outer surface 30 such that edge surfaces 38, 40 taper away from each other as surfaces 38, 40 extend from outer surface 30 to base surface 36. Slot 34 is tapered longitudinally because slot 34 gets wider as slot 34 extends axially away from the respective cover 12*a*, 12*b*—i.e., slot 34 is narrower at a first end 50 of slot 34 than at a second end 52 of slot 34 and an area of the trapezoidal cross-section at the first end 50 of slot 34 is smaller than an area of the trapezoidal cross-section at the second end 52 of slot 34. More specifically, surfaces 38, 40 extend away from each other as surfaces 38, 40 extend axially from the first end 50 of slot 34 to the second end 52 of slot 34 and edges 44, 48 extend away from each other as edges 44, 48 extend axially from the first end 50 of slot 24 to the second end 52 of slot 34.

Each slot 34 is configured for receiving and removably retaining a connector 54. Connector 54 is shown disengaged from slot 34 in FIG. 4. Connector 54 includes a first insertion section 56 for inserting in the slot 34 of one cell 10 and a second insertion section 58 for inserting in the slot 34 of another cell 10 to connect the cells 10 together. Connector 54 is symmetrically shaped such that first and second insertion sections 56, 58 are of identical size and shape.

Figure 4:
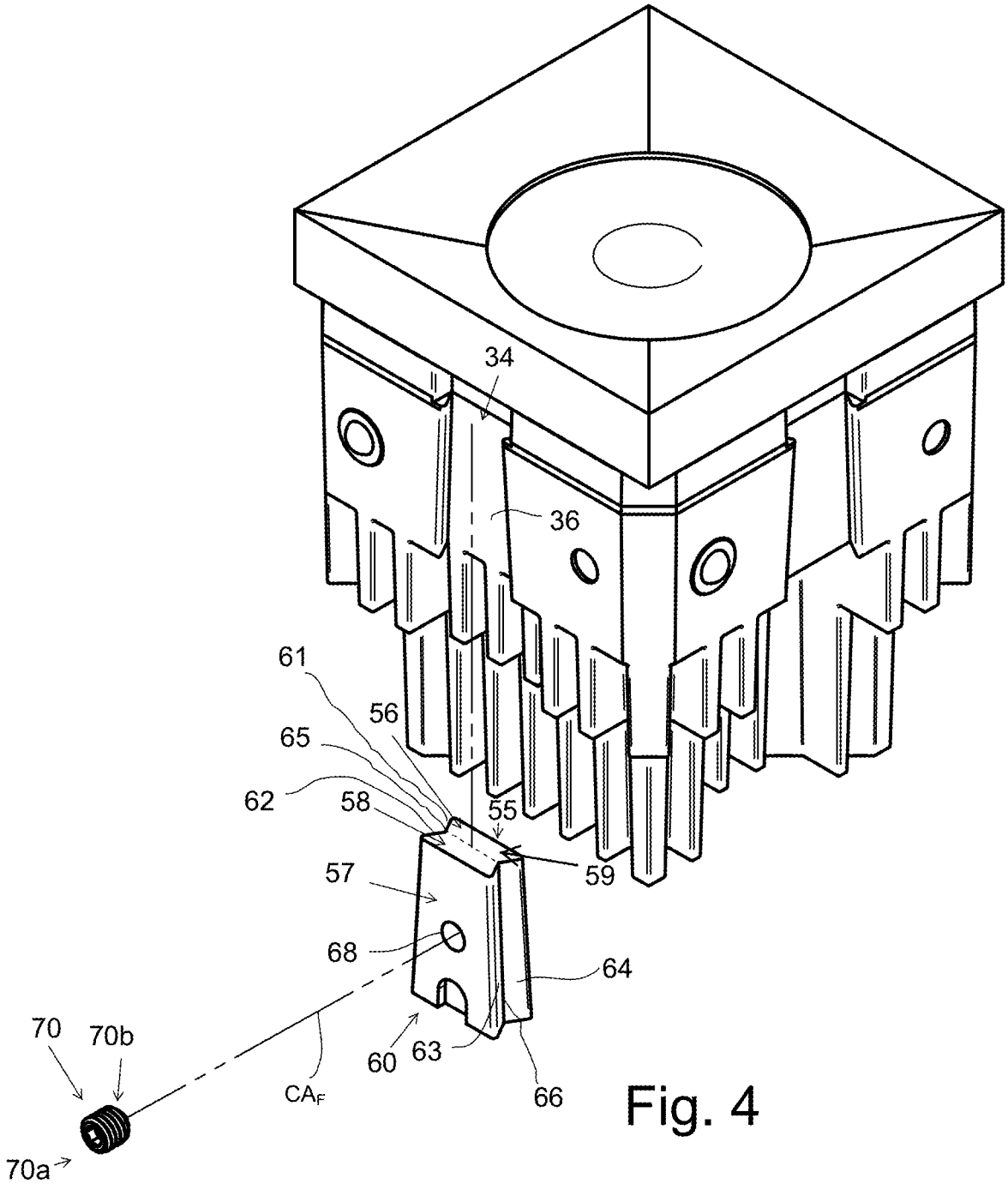
FIG. 4 shows a perspective view of the lighting cell shown in FIG. 1*a* and a removable connector spaced apart from a housing of the lighting cell.

In the embodiment shown in FIG. 4, insertion sections 56, 58 are each formed as an irregular trapezoidal prism that are joined together at a shared face of the irregular trapezoidal prisms. Connector 54 includes two outer faces 55, 57 of the same dimensions facing in opposite directions, a first end face 59 and a second end face 60, with first end face 59 having smaller dimensions than second end face 60. Outer faces 55, 57 each have a trapezoidal shape and end faces 59, 60 each have a shape of two conjoined trapezoids. Connector 54 further includes four lateral side faces 61 to 64, with a first lateral side of connector 54 being defined by two lateral side faces 61, 62 that are angled with respect to each other at an obtuse angle and a second lateral side of connector 54 being defined by two lateral side faces 63, 64 that are angled with respect to each other at an obtuse angle. Each of lateral side faces 62, 63 forms an acute angle with outer face 57 and each of lateral side faces 61, 64 forms an acute angle with outer face 55. Lateral side faces 61, 62 join at an edge 65 and lateral side faces 63, 64 join at an edge 66, with edges 65, 66 defining a plane of symmetry of connector 54.

Each of insertion sections 56, 58 has a complementary shape to slot 34 such that the each of insertion sections 56, 58 snugly wedges into the respective slot 34. In other words, each of insertion sections 56, 58 is also tapered longitudinally and tapered depthwise to mate with slots 34. Insertion sections 56, 58 are each tapered depthwise because each of insertion sections 56, 58 has a trapezoidal cross-section that gets wider as each insertion sections 56, 58 extends away from the plane of symmetry of connector 54. More specifically, lateral side faces 62, 63 taper away from each other as lateral side faces 62, 63 extend from the respective edge 65, 66 to outer face 57 and lateral side faces 61, 64 taper away from each other as lateral side faces 61, 64 extend from the respective edge 65, 66 to outer face 55. Each of insertion sections 56, 58 is tapered longitudinally because insertion sections 56, 58 each get wider as insertion sections 56, 58 extends away from the end face 59 and toward end face 60—i.e., insertion sections 56, 58 are each narrower at end face 59 than at end face 60 and an area of the trapezoidal cross-section at end face 59 of each insertion section 56, 58 is smaller than an area of the trapezoidal cross-section at end face 60 of each insertion section 56, 58. More specifically, lateral side faces 62, 63 extend away from each other as lateral side faces 62, 63 away from the end face 59 and toward end face 60 and lateral side faces 61, 64 extend away from each other as lateral side faces 61, 64 away from the end face 59 and toward end face 60. Due to the shape of slot 34 and insertion sections 56, 58, connector 54 can only enter slot 34 in one orientation, and connector 54 is limited in how far connector 54 can be forced axially upward into slot 34.

Connector 54 also includes a threaded hole 68 passing therethrough from outer face 55 to outer face 57 that is configured for receiving a fastener 70. Fastener 70 includes a threaded outer surface such that fastener 70 can be screwed into hole 68 via rotation with a tool, which is insertable into a hole at a first end 70*a* of fastener 70, and moved along a fastener axis $CA_F$ that extends traverse to outer faces 55, 56. In this manner, once connector 54 is aligned in the slot 34 of one of the lighting cells 10, connector 54 can be rotated in hole 68 to force a second end 70*b* of fastener 70 into contact with base surface 36 of the slot 34. By forcing fastener 70 against base surface 36, a temporary frictional force generated by fastener 70 prevents connector 54 from being axially movable in slot 34. In the embodiment shown in FIG. 4, fastener 70 is a set screw.

As shown in FIGS. 1*a* to 4, each wall 26 is provided with a male connector 71 that is part of a ball plunger 72 and a female connector in the form of a hole 74. In the embodiment shown in the Figures, male connectors 71 are received in and movable within a bore of plunger 72 in the respective wall 26 and are in the form of balls, although other shaped male connectors 71 can be used. A center axis $CA_P$ of each plunger 72 and a center axis $CA_H$ of each hole 74 are a same axial height on housing 16 and plunger 72 and hole 74 are configured such that each hole 74 is sized and shaped to receive a plunger 72 of another cell 10. As shown in FIGS. 2 and 3, each plunger 72 protrudes from the respective wall 26 and plunger 72 is the only portion of each wall 26, and the only portion of housing 16, that protrudes past surface 30. Accordingly, in the embodiment shown in FIGS. 2 and 3, each hole 74 does not include any part that protrudes from the respective wall 26. As also shown in FIGS. 2 and 3, side surfaces 15 of covers 12*a*, 12*b* join surfaces 30 of walls 26 of housing 16. Each side surface 30 is divided into two axially offset surface portions 30*a*, 30*b* by a die cast parting line 31. More specifically, a first surface portion 30*a* is adjacent to the respective surface 15 and a second surface portion 30*b* is further away from the respective surface 15 and separated from the respective surface 15 by the respective surface portion 30*a*. Surface portions 30*a* are aligned at a draft angle with respect to respective surfaces 12*a*, 12*b* for die casting and surface portions 30*b* are aligned at a draft angle with respect to surface portions 30*a* for die casting, such that surface portions 30*a* taper inward toward center axis CA as surface portions 30*a* extend away axially away from the respective surfaces 12*a*, 12*b* and such that surface portions 30*b* taper inward toward center axis CA as surface portions 30*b* extend away axially away from the respective surface portion 30*a*. The plane of symmetry of connector 54, which inserted in the slot 34 of the lighting cell 10, is also aligned with the plane of the respective surface 15 and the plane of the respective surface 30. Male connector 71 is biased away from center axis CA to extend out of wall 26 past the plane of the respective surfaces 15, 30 by an elastic element of plunger 72 such as a spring.

As shown in FIG. 3, each side of housing 16 has a same width W and the center axis $CA_P$ of each plunger 72 and the center axis $CA_H$ of each hole 74 are each spaced laterally from the nearest side edge by a distance X. Accordingly, the center axis $CA_P$ of each plunger 72 and the center axis $CA_H$ of each hole 74 for each wall 26 are separated from each other by a distance W-2X. In one exemplary embodiment, cells 10 each have a width W of 1.25 to 1.75 inches and a height H (FIG. 2) of 1.75 to 2.25 inches, for example a width W of 1.5 inches and a height H (FIG. 2) of 2 inches.

Removably fixing two cells 10 together first involves inserting connector 54 into the slot 34 of a first cell 10 such that the connector 54 is wedged into the slot 34 of the first cell 10, removably fixing the connector 54 axially in place in the slot 34 of the first cell 10 by actuating fastener 70, then aligning the first cell 10 and a second cell 10 with respect to each other such that the connector 54 is axially aligned with the slot 34 of the second cell 10, and then moving the first and/or second cell 10 axially until the connector 54 is received in the slot 34 of the second cell 10 such that the connector 54 is wedged into the slot 34 of the second cell 10. During these steps, the male connector 71 of a first of the two cells 10 being connected is received in the female connector 74 of a second of the two cells 10 being connected, and the male connector 71 of the second cell 10 is received in the female connector 74 of the first cell 10.

Referring to the exemplary embodiment shown in FIGS. 1*a* and 1*b*, insertion section 56 of connector 54 can first be inserted into one of the slots 34 of cell 10*a*, then fastener 70 is actuated in connector 54 until end 70*b* of fastener 70 contacts base surface 36 of the slot 34. Next, one or both of cells 10*a*, 10*b* are moved such that insertion section 58 of connector 54 is inserted into one of the slots 34 of cell 10*b*. Cells 10*a*, 10*b* are properly aligned when the male connector 71 of the wall 26 of cell 10*a* in which insertion section 56 is inserted is received in the female connector 74 of the wall 26 of cell 10*b* in which insertion section 56 is inserted, and the male connector 71 of the wall 26 of cell 10*b* in which insertion section 56 is inserted is received in the female connector 74 of the wall 26 of cell 10*a* in which insertion section 56 is inserted. Individual cells are connected to each other via a linear connector and ball plungers that lock the fixture into place by keying into corresponding hole. Cells 10 are each symmetrical on all four sides for mechanical connection, and can be rotated ninety degrees to provide an asymmetrical output. In other words, cells 10 can connect to each other at any 90 degree orientation about center axis CA.

Figure 5:
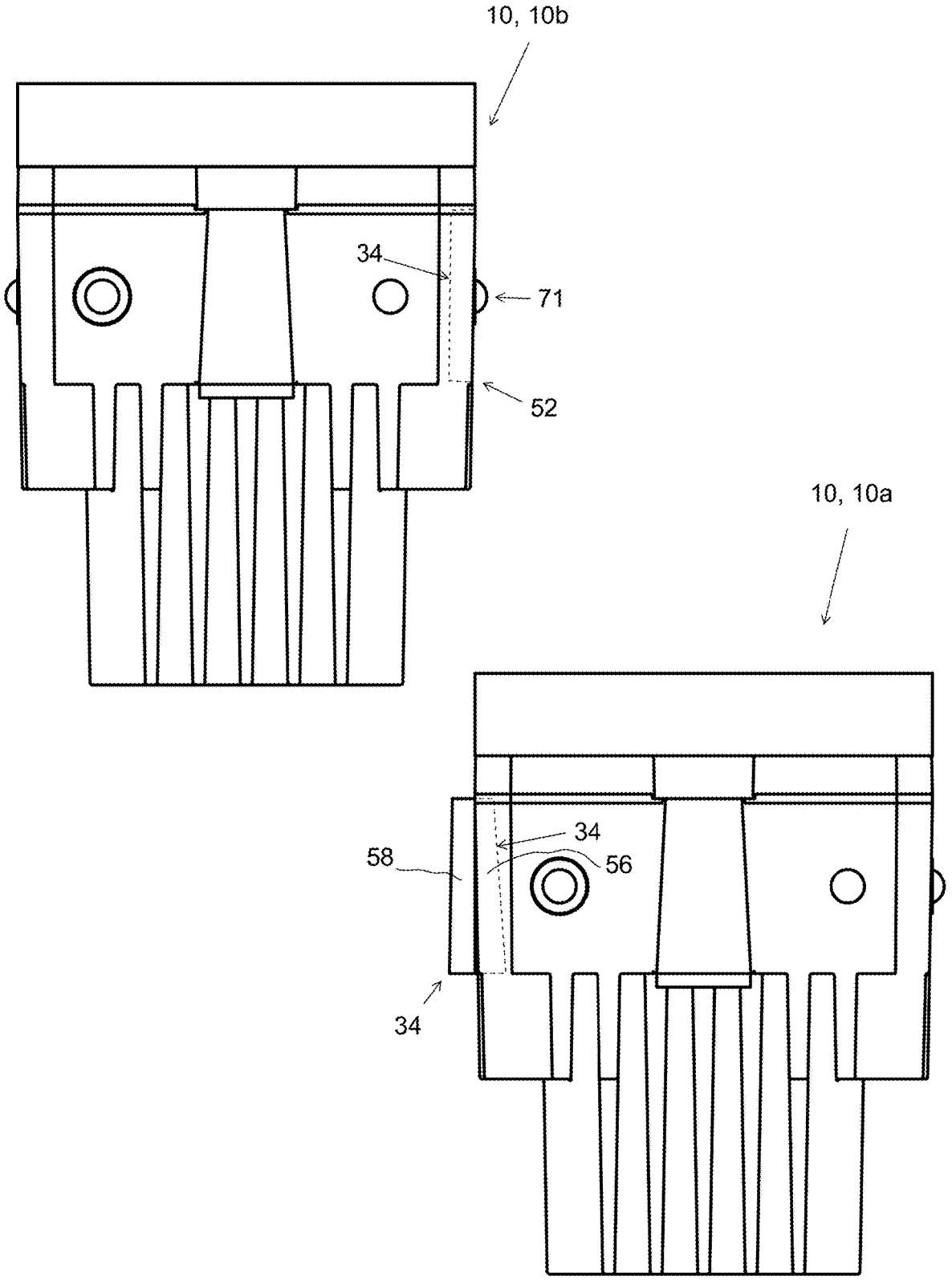
FIG. 5 shows a side view of two lighting cells, illustrating how the lighting cells are connectable together.

More specifically, insertion section 56 of connector 54 is axially inserted into one of the slots 34 of cell 10*a* until outer face 55 of insertion section 56 contacts base surface 36 of slot 34 and side faces 61, 64 of insertion section 56 contact edge surfaces 38, 40 of slot 34, wedging insertion section 56 in the slot 34 of cell 10*a*. Then, fastener 70 is rotated by a tool inserted into the hole in end 70*a* such that fastener 70 is actuated in connector 54 until end 70*b* of fastener 70 contacts base surface 36 of the slot 34. Next, as shown in FIG. 5, and considering the details shown in FIGS. 1*a*, 1*b* and 4, the bottom end 52 of one of the slots 34 of cell 10*b* is slid axially onto insertion section 58 of connector 54. This movement is continued such that insertion section 58 is axially inserted into the slot 34 of cell 10*a* until outer face 57 of insertion section 58 contacts base surface 36 of the slot 34 and side faces 62, 63 of insertion section 58 contact edge surfaces 38, 40 of slot 34, wedging insertion section 58 in the slot 34 of cell 10*b*. When this contact between surfaces 36, 38, 40 of slot 34 and faces 57, 62, 63 occurs, the male connector 71 of the respective wall 26 of cell 10*a* is received in the female connector 74 of the respective wall 26 of cell 10*b*, and the male connector 71 of the respective wall 26 of cell 10*b* is received in the female connector 74 of the respective wall 26 of cell 10*a*.

Figure 6:
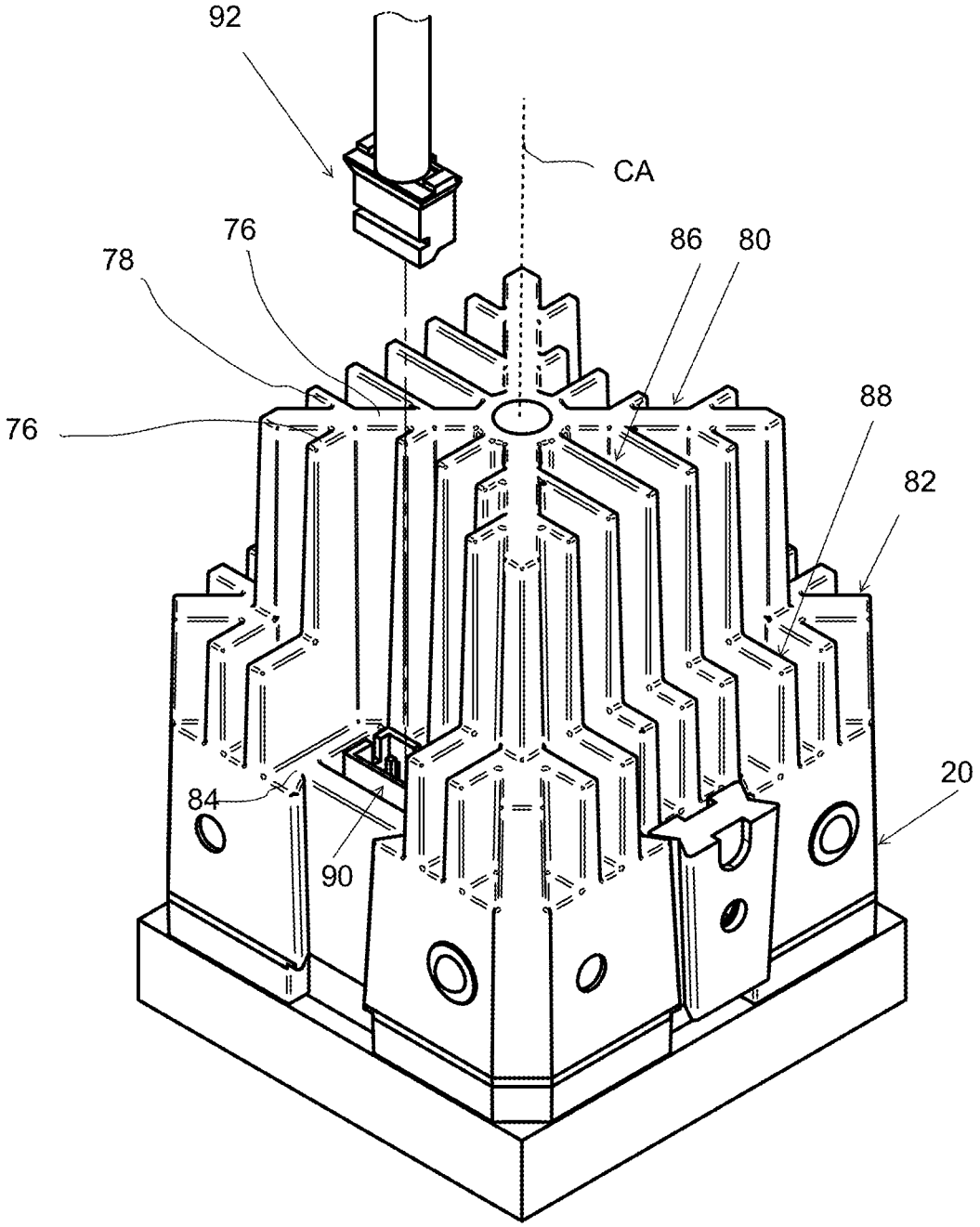
FIG. 6 shows a perspective view of a bottom of one of the lighting cells.

FIG. 6 shows a perspective view of a bottom of one lighting cell 10. As shown in FIG. 6, heat sink 22 includes a plurality of base fins 76 that are joined together by a center section 78 of heat sink 22. In the embodiment shown in FIG. 6, heat sink 22 includes four base fins 76 that are each separated from the two adjacent base fins 76 by ninety degree angles. A plurality of branch fins 76 extend from each base fin 76 in two opposite directions. Each of base fins 76 extends radially from center section 78 to a respective one of corner sections 28. Base fins 76 each have a stepped configuration such that radially centrals portions 80 of base fins 76 each are of a first axial height that is greater than a second axial height of radially outer portions 82 of base fins 76. In other words, central portions 80 extend further from a bottom surface 84 of hollow base 20 than outer portions 82. A majority of branch fins 76 also have a stepped configuration such that radially central portions 86 of branch fins 76 each are of the first axial height that is greater than the second axial height of radially outer portions 88 of branch fins 76.

Hollow base 20 also includes two non-directional electrical receptacles 90, 91 (FIG. 8)—each which can an act as an input or output—formed in bottom surface 84 and that are each configured for receiving an electrical connector 92 of wiring. Connector 92 is on one of end of the wiring and cells 10 are electrically connectable by inserting a connector 92 on the other end of the wiring into a receptacle 90, 91 of another cell 10. For example, cells 10 can be daisy chained to each other with a board having two connectors on opposite sides. A control system for controlling a plurality of connected cells 10 can for example connect sixteen individual cells with up to four channels for controlling the dimming of cells 10 per channel. Wire assemblies of various lengths can be used to allow for non-adjacent cells 10 to be connected together.

Figure 7:
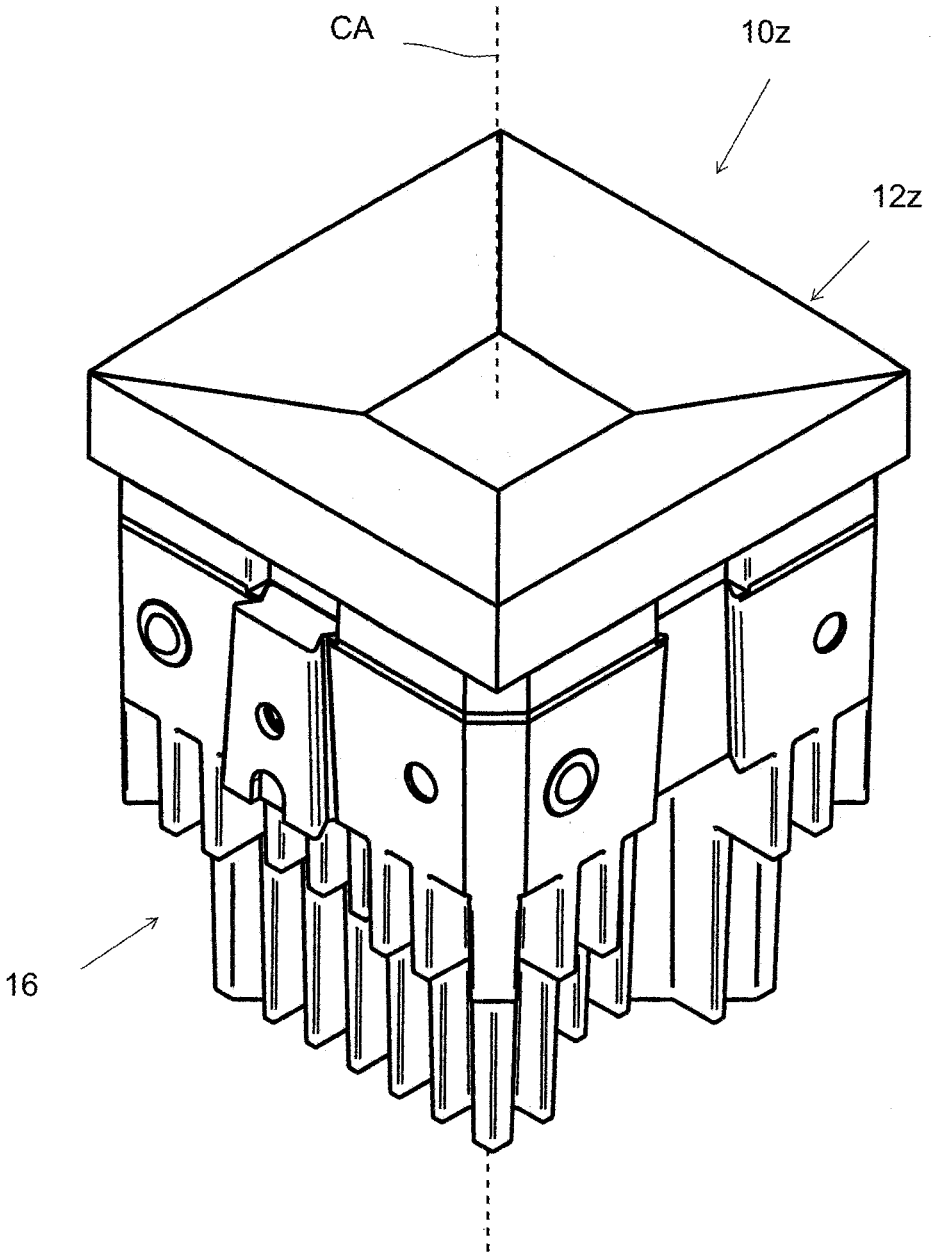
FIG. 7 shows a perspective view of an interconnectable dummy cell in accordance with an embodiment of the present invention.

FIG. 7 shows a perspective view of a dummy cell 10*z* that is connectable to either of cells 10*a*, 10*b* via connectors 54. Dummy cell 10*z* is configured in a similar manner as cells 10*a*, 10*b*, except that dummy cell 10*z* does not include a light assembly and is merely a hollow cell provided with a continuous cover 12*z*—i.e., one that does not include a hole passing therethough. Cell 10*z* includes a housing 16 configured in the same manner as cells 10*a*, 10*b* and is configured for being arranged in with cells 10*a*, 10*b* in a lighting unit. Cell 10*z* does not emit light and is provided to space light cells 10 from each other in a desired pattern and shape.

Figure 8:
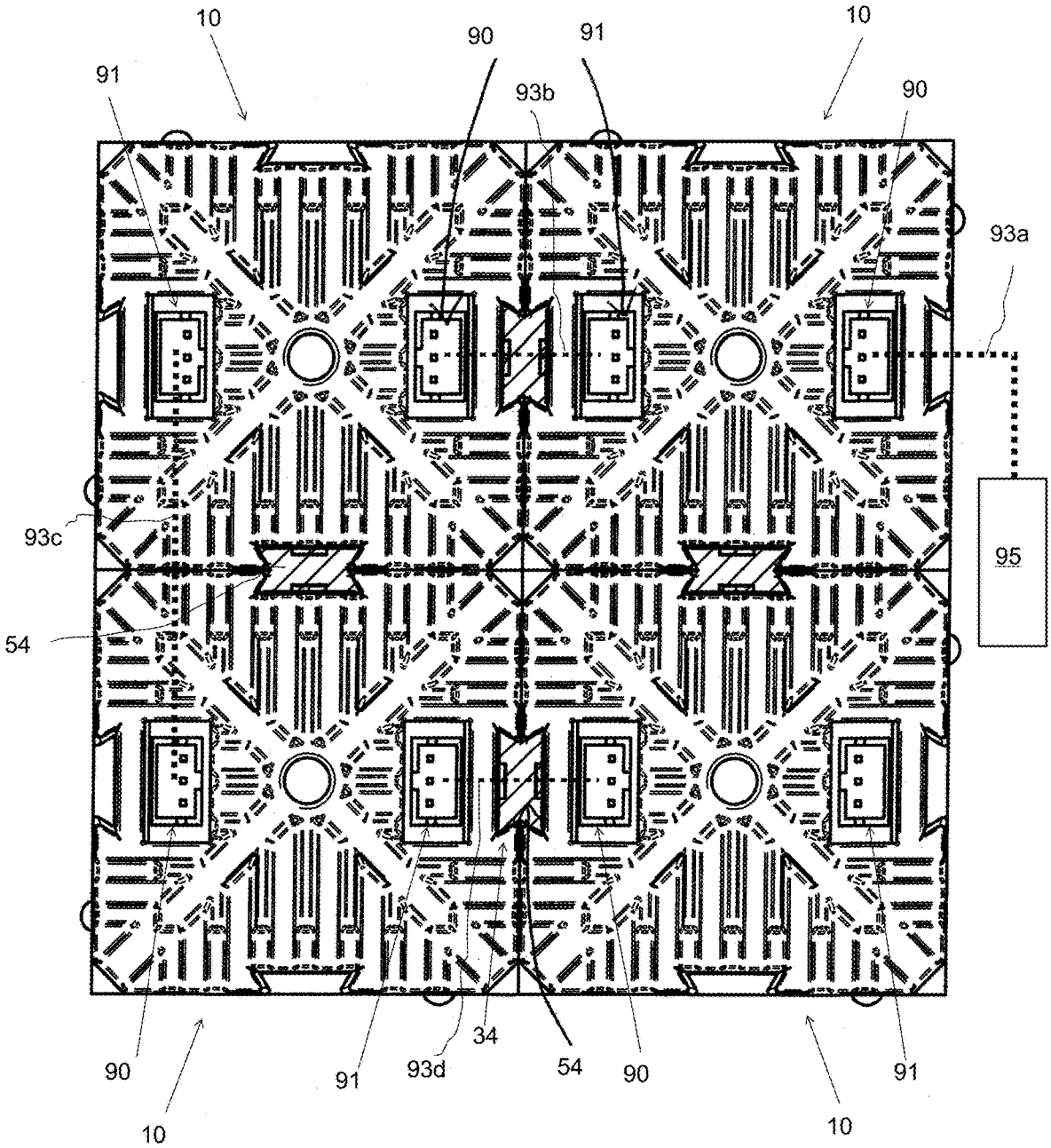
FIG. 8 shows a bottom plan view of a modular lighting unit formed by a four lighting cells removably connected together by four connectors.

FIG. 8 shows a bottom plan view of a modular lighting unit formed by a four cells 10 removably connected together by four connectors 54. Each connector 54 is received in the slots 34 of two different cells 10, and each cell 10 has connectors 54 in two different slots 34. As shown in FIG. 8, each cell 10 includes a first non-directional receptacle 90 and a second non-directional receptacle 91 and the cells are daisy chained together and are connected to a control system 95. In the example shown in FIG. 8, the first receptacle 90 of the upper right cell is electrically connected to control system 95 by a schematically shown wiring 93*a* that is electrically connected to control system 95. The second receptacle 91 of the upper right cell 10 is electrically connected to the first receptacle 90 of the upper left cell 10 by a wiring 93*b*. The second receptacle 91 of the upper left cell 10 is electrically connected to the first receptacle 90 of the lower left cell 10 by a wiring 93*c*. The second receptacle 91 of the lower left cell 10 is electrically connected to the first receptacle 90 of the lower right cell 10 by a wiring 93*d*. Each of wiring 93*a*, 93*b*, 93*c*, 93*d* provides both positive and negative terminals to close the electrical loop with control system 95. An additional cell 10 can thus be easily added to the lighting unit of FIG. 8 by adding an addition wiring to the additional cell 10 from second receptacle 91 of the lower right cell 10.

Figure 9:
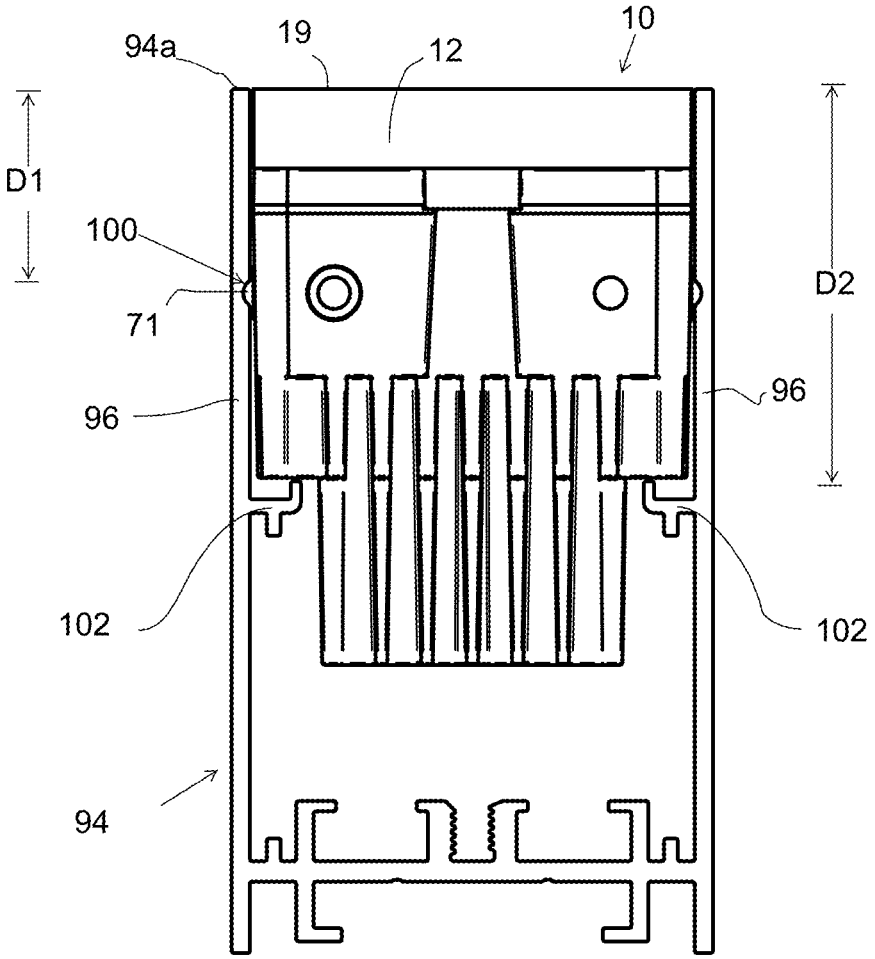
FIG. 9 shows a cross-sectional view of a fixture frame supporting a lighting cell.

FIG. 9 shows a cross-sectional view of a fixture frame 94 supporting a cell 10. Fixture frame 94 includes side walls 96 separated by an opening 98 in which cover 12 is aligned for outputting light from the light source of cell 10 through opening 98. An inner surface of each of walls 96 is provided with a recess 100 configured for receiving one of male connectors 71. A center of each of recesses 100 is the same distance D1 away from top edge 94*a* of frame 94 as centers of connectors 71 are from top edge 19 of cover 12 such that top edges 19 are at the same height as top edges 94*a* when cells 10 are installed in frame 94. Further away from opening 98 than recesses 100, each side wall 96 includes a respective rail 102. Bottom surfaces of radially outer portions 82, 88 of fins 76, 78 contact upper surfaces of rails 102. Fins 76, 78 are designed such that bottom surfaces of radially outer portions 82, 88 of fins 76, 78 are the same distance D2 from top edges 19 of cover 12 as upper surfaces of rails 102 are from top edges 94*a*.

Each of cells 10 includes identical walls 26 that can each be connected to a further cell 10 by a respective connector 54. Accordingly, cells 10 are configured to each be directly connectable via connectors 54 to four further cells. Of course, in desired arrangements of a plurality of cells 10 to form a lighting unit, not all of walls 26 of each cell 10 are provided with a connector 54 for connecting to a further cell at the wall 26. For example, corner cells 10 of a non-linear lighting unit may only be directly connected via connectors 54 to two further cells 10, and periphery non-corner cells of a non-linear lighting unit be only be directly connected via connectors 54 to three further cells 10.

Cells 10 can be used to form lighting assemblies with light sources that have light geometrical outputs having any mixture of wall wash, spot, medium, flood or oval, based on the type of lens in the light source. The spot may have a beam angle of less than 20°, the medium may have a beam angle of 21 to 35°, the flood may have a beam angle of greater than 51°, and oval may have an asymmetrical output having a width beam angle that is less than a length beam angle. Cover 12*a* can be used for spot, medium, flood and oval light outputs and cover 12*b* and be used for wall wash light outputs.

Figure 10:
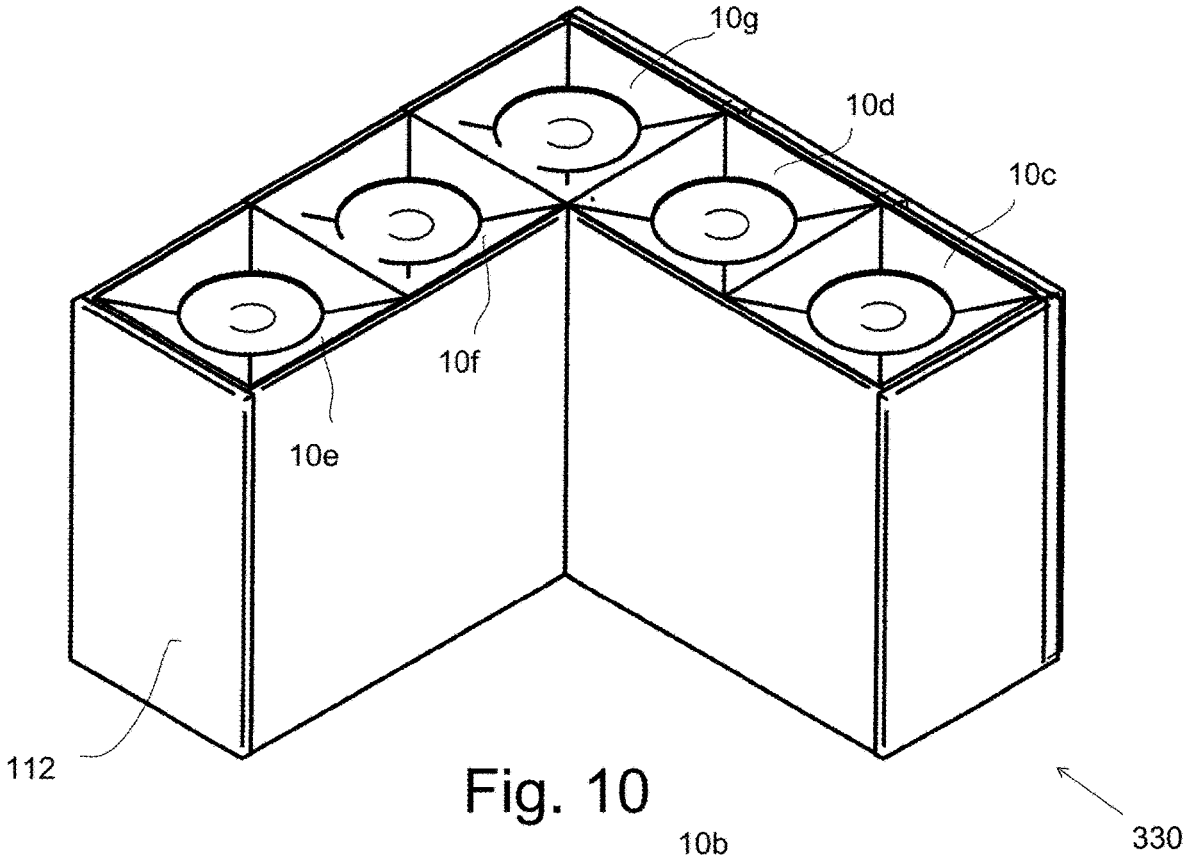
FIG. 10 illustrates an exemplary L-shaped lighting unit formed by five lighting cells.

FIG. 10 illustrates an exemplary lighting unit 330 formed by five cells 10. Lighting unit 330 has an L-shape, defined by an L-shaped frame 112, and includes a first linear section 114 formed by two cells 10*c*, 10*d*, a second linear section 116 formed by two cells 10*e*, 10*f* and a corner section 118 connecting sections 112, 114 formed by a single cell 10*g*. End cells 10*c*, 10*e* are each only directly connected to one cell 10—cells 10*d*, 10*f*, respectively—and each includes a connector 54 in only one of its slots 34. Cells 10*d*, 10*f*, 10*g* are each directly connected to two cells 10—cell 10*d* is directly connected to cells 10*c*, 10*g*; cell 10*f* is directly connected to cells 10*e*, 10*g*; and cell 10*g* is directly connected to cells 10*d*, 10*f*—and each includes a connector 54 in two of its slots 34. The cells 10 in FIG. 10 can each provide a same spot, medium, flood or oval output such that the cells 10 or each cell 10 can provide a different output from among same spot, medium, flood or oval.

Figure 11:
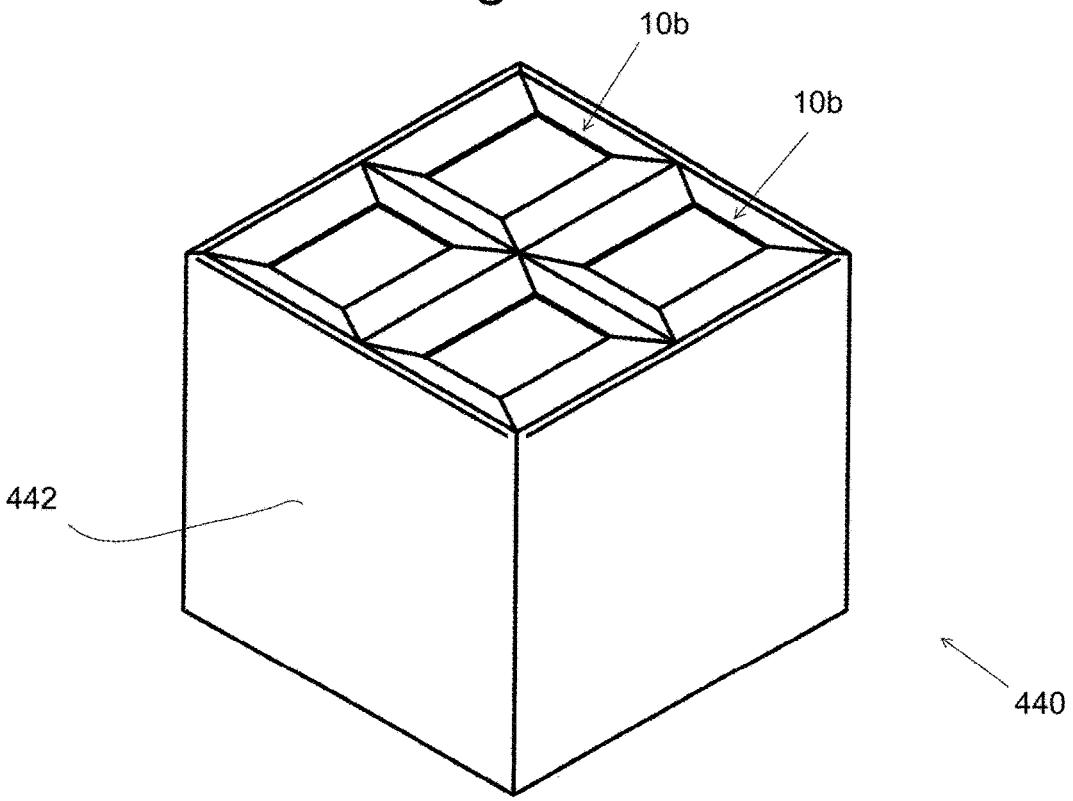
FIG. 11 illustrates an exemplary square lighting unit formed by four cells.

FIG. 11 illustrates an exemplary lighting unit 440 formed by four cells 10 arranged in a square shape in a square frame 442. Cells 10 may be connected in the same manner as shown in FIG. 5 and include four cells 10 that are all cells 10*b* described with respect to FIG. 1*b*. The cells 10 in FIG. 11 can each provide a same spot, medium, flood or oval output such that the cells 10 or each cell 10 can provide a different output from among same spot, medium, flood or oval.

Figure 12:
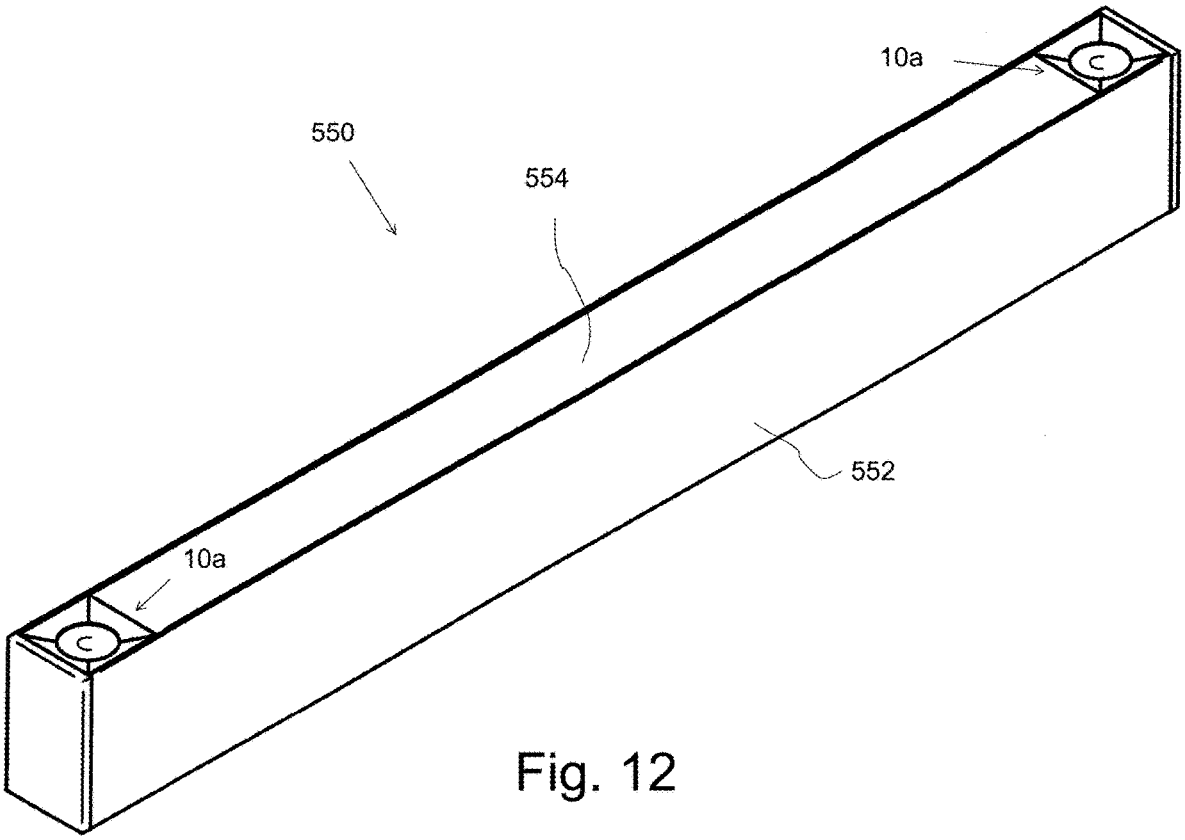
FIG. 12 illustrates an exemplary linear lighting unit including two lighting cells.

FIG. 12 illustrates an exemplary linear lighting unit 550. In FIG. 12, unit 550 includes only two cells 10, which are both cells 10*a* described with respect to FIG. 1*a*. The cells 10 in FIG. 12 are provided at opposite ends of frame 552 and a linear light 554 is provided between cells 10*a*. In an alternative arrangement, linear frame 552 that is configured to support a single row of cells 10 and the entirety of frame 552 can be filled with cells 10 that are directly contacting adjacent cells 10. As a further example, three cells 10 could be pushed together at one end of frame 552, and three cells 10 could be pushed together at another end of frame 552, with a shorter linear light provided therebetween.

Figure 13A:
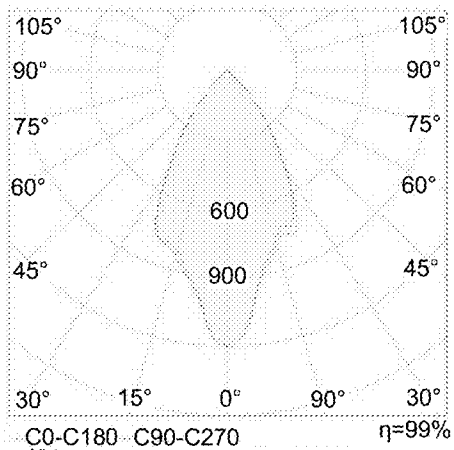
FIGS. 13*a* to 13*f* illustrate output beams of different geometries, each including a plot of the output beam on top, and a photo of the output beam on bottom.
Figure 13A:
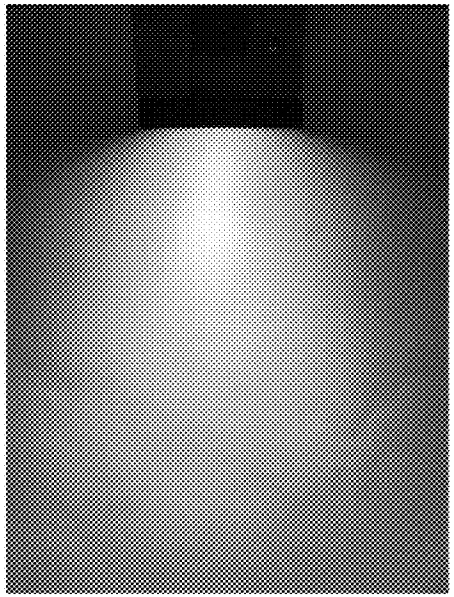
Figure 13B:
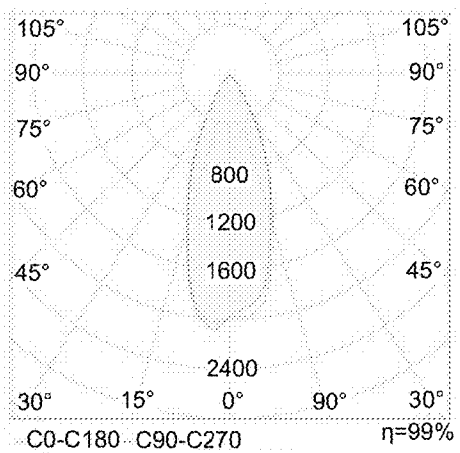
Figure 13B:
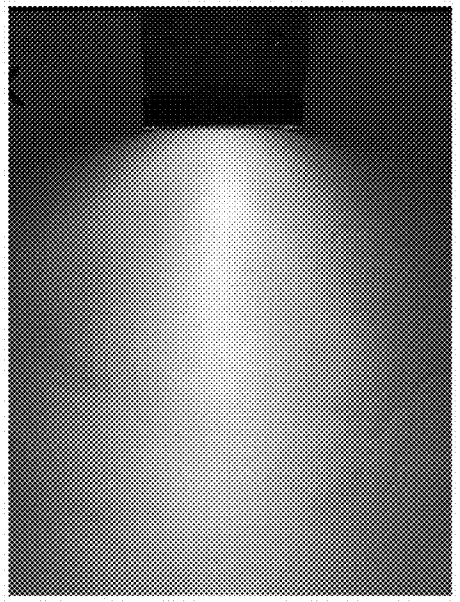
Figure 13C:
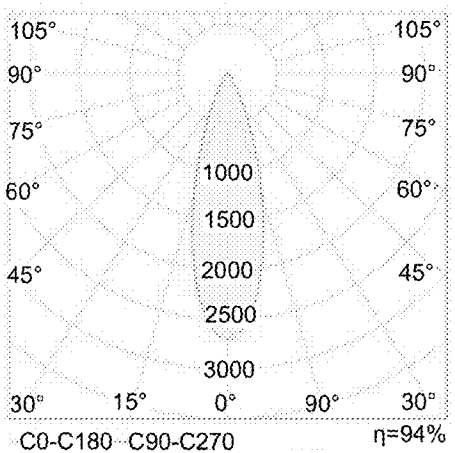
Figure 13C:
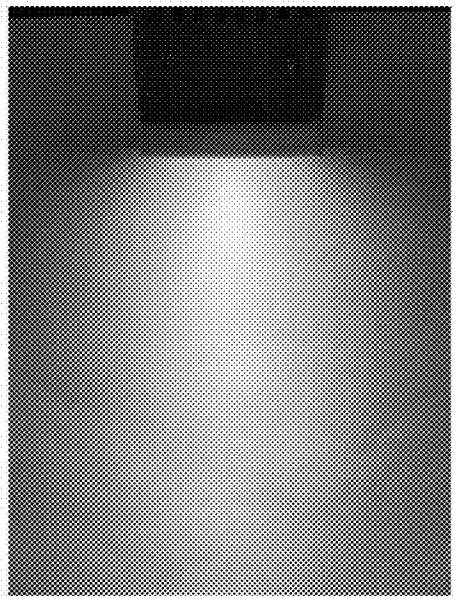
Figure 13D:
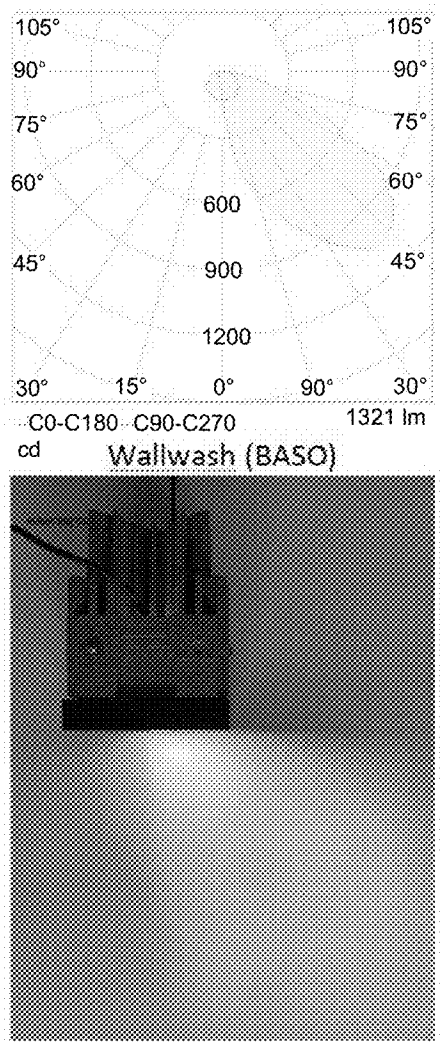
Figure 13E:
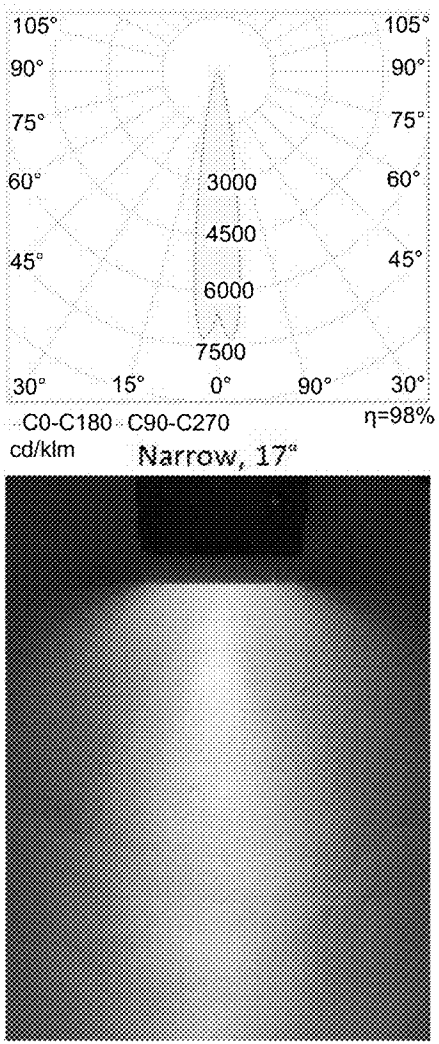
Figure 13F:
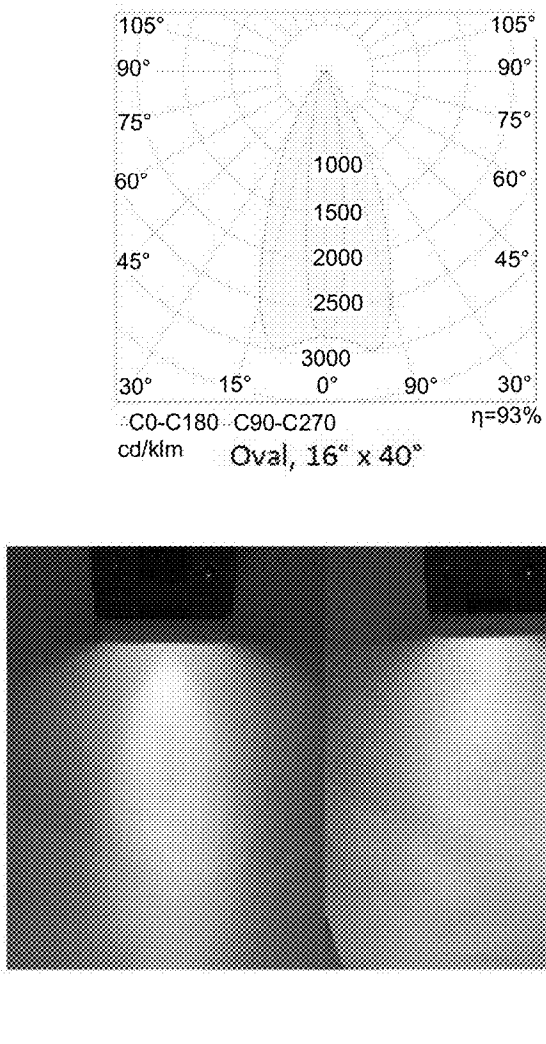

FIGS. 13*a* to 13*f* illustrate output beams of different geometries, each including a plot of the output beam on top, and a photo of the output beam on bottom. FIG. 13*a* illustrates an exemplary super wide output beam having a beam angle width of 57 degrees. FIG. 13*b* illustrates an exemplary wide beam output having a beam angle width of 36 degrees. FIG. 13*c* illustrates an exemplary medium output beam having a beam angle width of 30 degrees. FIG. 13*d* illustrates an exemplary wall wash output beam. FIG. 13*e* illustrates an exemplary spot or narrow output beam having a beam angle width of 17 degrees. FIG. 13*f* illustrates an exemplary oval output beam having a width beam angle of 16 degrees and a length beam angle of 40 degrees.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A modular lighting cell comprising:

a light assembly;

a housing including a plurality of side walls;

a cover, the housing and the cover enclosing the light assembly;

a connector, the connector and at least one of the side walls being configured such that the connector is removably connectable to the at least one side wall; and a fastener configured for removably connecting the connector to the at least one side wall of the housing, the fastener being configured for being movable with respect to the connector.

2. The modular lighting cell as recited in claim 1 wherein the at least one side wall includes a slot, the connector being configured for removably connecting to the at least one side wall by being received in the slot of the at least one side wall.

3. The modular lighting cell as recited in claim 2 wherein the connector includes a first insertion section configured for being removably received in the slot of the at least one side wall and a second insertion section configured for being outside of the slot of the at least one side wall as the first insertion section is removably received in the slot of the at least one side wall.

4. The modular lighting cell as recited in claim 3 wherein the first insertion section and the second insertion section are identically sized and shaped and the second insertion section is configured for being removably received in a slot of at least one further side wall of a further modular lighting cell as the first insertion section is removably received in the at least one slot of the side wall of the modular lighting cell.

5. The modular lighting cell as recited in claim 4 wherein the first insertion section and the second insertion section are each formed as an irregular trapezoidal prism, the irregular trapezoidal prisms being joined together at a shared face of the irregular trapezoidal prisms.

6. The modular lighting cell as recited in claim 2 wherein the slot has a tapered shape and the connector has an insertion section having a tapered shape such that the insertion section is configured for being wedged into the slot.

7. The modular lighting cell as recited in claim 6 wherein the slot and the insertion section are each tapered longitudinally and tapered depthwise.

8. The modular lighting cell as recited in claim 1 wherein the fastener is configured for being actuatable in a hole of the connector to contact a surface of the at least one side wall.

9. The modular lighting cell as recited in claim 1 wherein the light assembly includes a light source emitting light and optics redirecting the emitted light into a beam output through the cover.

10. The modular lighting cell as recited in claim 1 wherein the at least one side wall includes a male connector and a female connector, the at least one side wall being configured such that the male connector is configured for being removably received in a further female connector of at least one further side wall of a further modular lighting cell as the female connector removably receives a further male connector of the at least one further side wall.

11. The modular lighting cell as recited in claim 1 wherein the housing includes a hollow base fixed to the cover and a heat sink, the hollow base being axially between the heat sink and the cover.

12. The modular lighting cell as recited in claim 1 wherein the connector and the plurality of the side walls are configured such that the connector is removably connectable to each of the side walls one at a time.

13. The modular lighting cell as recited in claim 12 wherein each of the plurality of side walls includes a respective slot, the connector being configured for removably connecting to each of the plurality of side walls one at a time by being received in each of the respective slots.

14. A modular lighting unit comprising:

a first lighting cell including a first light assembly and a first housing receiving the first light assembly;

a second lighting cell including a second light assembly and a second housing receiving the second light assembly;

a third cell including a third housing, the third housing not including a light assembly;

a connector configured for connecting to the first lighting cell and for connecting to the second lighting cell to connect the first lighting cell and the second lighting cell to each other; and a second connector configured for connecting to the second lighting cell and for connecting to the third cell to connect the second lighting cell and the third cell to each other.

15. A modular lighting unit comprising:

a first lighting cell including a first light assembly and a first housing receiving the first light assembly;

a second lighting cell including a second light assembly and a second housing receiving the second light assembly; and a connector configured for connecting to the first lighting cell and for connecting to the second lighting cell to connect the first lighting cell and the second lighting cell to each other, wherein the first light assembly generates a first light output and the second light assembly generates a second light output, the first light output having a different beam angle than the second light output.

16. The modular lighting unit as recited in claim 15 wherein the first housing includes a plurality of first side walls and the second housing includes a plurality of second side walls, the connector including a first insertion section that is configured for attaching to any of the first side walls and any of the second side walls, the connector including a second insertion section that is configured for attaching to any of the first side walls and any of the second side walls.

17. The modular lighting unit as recited in claim 16 wherein the connector is configured such that the first insertion section is attachable to one of the first side walls while the second insertion section is attached to one of the second side walls, and the connector is configured such that the second insertion section is attachable to one of the first side walls while the first insertion section is attached to one of the second side walls.

18. The modular lighting unit as recited in claim 15 wherein the first light output and the second light output are chosen from a group consisting of wall wash, spot, medium, flood and oval.

19. The modular lighting unit as recited in claim 18 wherein the spot has a beam angle of less than 20°, the medium has a beam angle of 21 to 35°, the flood has a beam angle of greater than 51°, and the oval has an asymmetrical output having a width beam angle that is less than a length beam angle.

20. The modular lighting unit as recited in claim 16 wherein all of the first side walls are symmetrical and all of the second side walls are symmetrical.

21. The modular lighting unit as recited in claim 16 wherein all of the first side walls and the second side walls are identical.

22. The modular lighting unit as recited in claim 15 further comprising a plurality of additional lighting cells connected to the first and second lighting cells by further connectors.

23. The modular lighting unit as recited in claim 15 wherein the first light assembly includes first optics and the second light assembly includes second optics different from the first optics.

* * * * *